US007895670B2

(12) United States Patent
Kleinert

(10) Patent No.: US 7,895,670 B2
(45) Date of Patent: Mar. 1, 2011

(54) GLOVE

(75) Inventor: James M. Kleinert, Louisville, KY (US)

(73) Assignee: Hillerich & Bradsby Co., Louisville, KY (US)

( * ) Notice: Subject to any disclaimer, the term of this patent is extended or adjusted under 35 U.S.C. 154(b) by 240 days.

(21) Appl. No.: 11/462,075

(22) Filed: Aug. 3, 2006

(65) Prior Publication Data

US 2008/0034468 A1 Feb. 14, 2008

(51) Int. Cl.
*A41D 19/00* (2006.01)

(52) U.S. Cl. ..... 2/161.1; 2/161.2

(58) Field of Classification Search ..... 2/16, 2/159, 161.1, 161.2, 161.6, 163, 167
See application file for complete search history.

(56) References Cited

U.S. PATENT DOCUMENTS

| | | | |
|---|---|---|---|
| 325,968 | A | 9/1885 | Rawilings |
| 385,728 | A | 7/1888 | Sauer |
| RE12,996 | E | 7/1909 | Peach |
| 1,018,271 | A | 2/1912 | Rogers |
| 1,202,705 | A | 10/1916 | Goldsmith et al. |
| 1,435,478 | A | 11/1922 | Kennedy |
| 1,436,131 | A | 11/1922 | Whitley |
| 1,496,824 | A | 6/1924 | Nixon, Jr. |
| 1,525,298 | A | 2/1925 | Hartman |
| 1,552,080 | A | 9/1925 | Rainey |
| 1,562,176 | A | 11/1925 | Latina |
| RE16,272 | E | 2/1926 | Green |
| 1,594,304 | A | 7/1926 | Klahn et al. |
| D072,069 | S | 2/1927 | Meyers |
| 1,716,221 | A | 6/1929 | Fernie |
| 1,841,193 | A | 1/1932 | Lidston |
| 1,900,395 | A | 3/1933 | Gitt, 2d |
| 2,083,935 | A | 6/1937 | Arnold |
| 2,258,999 | A | 10/1941 | Nunn |
| 2,344,080 | A | 3/1944 | Burgett |
| 2,369,115 | A | 2/1945 | Bloom |
| 2,465,136 | A | 3/1949 | Troccoli |
| 2,528,802 | A | 11/1950 | Turner |
| 2,558,544 | A | 6/1951 | Delsalle |
| 2,636,172 | A | 4/1953 | Stobbe |
| 2,750,594 | A | 6/1956 | Denkert |
| 2,975,429 | A | 3/1961 | Newman |
| 2,980,915 | A | 4/1961 | Peterson |

(Continued)

FOREIGN PATENT DOCUMENTS

| | | |
|---|---|---|
| GB | 710394 | 6/1954 |

(Continued)

*Primary Examiner*—Gary Y Welch
*Assistant Examiner*—Sally C Cline
(74) *Attorney, Agent, or Firm*—Charles G. Lamb; Middleton Reutlinger

(57) ABSTRACT

A glove is provided to flex as the user clinches his fist. The glove is provided with expandable zones on both sides of the top portion of the glove. Two expandable zones are positioned over the metacarpalphalangeal joints of the one small finger and the index finger. A third expandable zone is positioned to overly the center axis of rotation of the metacarpalphalangeal joints of the long finger and the ring finger. Cooperating relationship between the three expandable zones allow for expansion of the glove, both longitudinally and laterally, over the metacarpalphalangeal joints of the hand.

13 Claims, 5 Drawing Sheets

U.S. PATENT DOCUMENTS

| | | | | |
|---|---|---|---|---|
| 3,042,929 | A | | 7/1962 | Kobos |
| 3,096,523 | A | | 7/1963 | Bruchas |
| 3,164,841 | A | | 1/1965 | Burtoff |
| 3,175,226 | A | | 3/1965 | Weinberg |
| 3,273,165 | A | | 9/1966 | Sperandeo |
| 3,290,695 | A | | 12/1966 | Burtoff |
| 3,300,787 | A | | 1/1967 | Denkert |
| 3,411,222 | A | | 11/1968 | Williams |
| D213,287 | S | | 2/1969 | Khazzam |
| 3,458,867 | A | | 8/1969 | Moore et al. |
| 3,532,344 | A | | 10/1970 | Masstab |
| 3,564,613 | A | | 2/1971 | Fowler |
| 3,576,036 | A | | 4/1971 | Latina |
| 3,588,915 | A | | 6/1971 | Latina |
| 3,605,117 | A | | 9/1971 | Latina |
| 3,606,614 | A | | 9/1971 | Dimitroff |
| 3,649,966 | A | * | 3/1972 | Shields ..... 2/159 |
| 3,707,730 | A | | 1/1973 | Slider |
| 3,918,096 | A | | 11/1975 | Lim |
| D240,671 | S | | 7/1976 | McTear |
| D240,672 | S | | 7/1976 | McTear |
| 3,997,922 | A | | 12/1976 | Huhta |
| 3,997,992 | A | | 12/1976 | Anderson |
| 4,027,339 | A | | 6/1977 | Brucker |
| 4,038,787 | A | | 8/1977 | Bianchi |
| 4,042,975 | A | | 8/1977 | Elliott, Jr. et al. |
| 4,051,552 | A | | 10/1977 | Widdemer |
| 4,051,553 | A | | 10/1977 | Howard |
| 4,067,063 | A | | 1/1978 | Ettinger |
| 4,068,312 | A | | 1/1978 | Ledesma |
| 4,084,584 | A | | 4/1978 | Detty |
| 4,095,292 | A | | 6/1978 | Klein |
| D248,898 | S | | 8/1978 | DeLeone et al. |
| 4,137,572 | A | | 2/1979 | Jansson et al. |
| 4,187,557 | A | | 2/1980 | Tombari |
| 4,201,203 | A | | 5/1980 | Applegate |
| 4,250,578 | A | | 2/1981 | Barlow |
| 4,272,849 | A | | 6/1981 | Thurston et al. |
| 4,272,850 | A | | 6/1981 | Rule |
| 4,287,885 | A | | 9/1981 | Applegate |
| 4,329,741 | A | | 5/1982 | Bach |
| 4,346,481 | A | | 8/1982 | Latina |
| 4,438,532 | A | | 3/1984 | Campanella et al. |
| 4,445,507 | A | | 5/1984 | Eisenberg |
| 4,524,464 | A | | 6/1985 | Primiano et al. |
| 4,546,495 | A | | 10/1985 | Castillo |
| 4,561,122 | A | | 12/1985 | Stanley et al. |
| 4,570,269 | A | | 2/1986 | Berlese |
| 4,589,146 | A | | 5/1986 | Taylor |
| 4,590,625 | A | | 5/1986 | Keim |
| 4,630,318 | A | | 12/1986 | Aoki |
| 4,663,783 | A | | 5/1987 | Obayashi |
| 4,665,561 | A | | 5/1987 | Aoki |
| 4,677,698 | A | | 7/1987 | Angas |
| 4,684,123 | A | | 8/1987 | Fabry |
| 4,691,387 | A | | 9/1987 | Lopez |
| 4,700,404 | A | | 10/1987 | Potvin |
| D294,984 | S | | 3/1988 | Green |
| 4,747,163 | A | | 5/1988 | Dzierson |
| 4,748,690 | A | | 6/1988 | Webster |
| 4,751,749 | A | | 6/1988 | Cowhey |
| 4,766,612 | A | | 8/1988 | Patton, Sr. |
| 4,815,147 | A | | 3/1989 | Gazzano et al. |
| 4,847,915 | A | | 7/1989 | Keene |
| 4,850,053 | A | | 7/1989 | Tepley et al. |
| 4,864,659 | A | | 9/1989 | Morris |
| 4,864,660 | A | | 9/1989 | Sawyer |
| 4,891,845 | A | | 1/1990 | Hayes |
| 4,896,376 | A | | 1/1990 | Miner |
| 4,911,433 | A | | 3/1990 | Walker et al. |
| 4,930,162 | A | | 6/1990 | Côté |
| 4,958,384 | A | | 9/1990 | McCrane |
| 4,967,418 | A | | 11/1990 | Marcotte |
| 5,004,227 | A | | 4/1991 | Hoffman |
| 5,016,286 | A | | 5/1991 | Henriksen |
| 5,028,050 | A | | 7/1991 | Freyer |
| 5,031,238 | A | | 7/1991 | Hayes |
| 5,058,209 | A | | 10/1991 | Eisenberg |
| 5,067,175 | A | | 11/1991 | Gold |
| 5,083,361 | A | | 1/1992 | Rudy |
| 5,107,544 | A | | 4/1992 | Capatosto |
| D328,369 | S | | 7/1992 | Hong |
| 5,136,725 | A | | 8/1992 | Montero |
| 5,146,624 | A | | 9/1992 | Brückner |
| 5,168,576 | A | | 12/1992 | Krent et al. |
| 5,168,578 | A | | 12/1992 | Stanley |
| D332,845 | S | | 1/1993 | Johnston |
| 5,175,886 | A | | 1/1993 | Suk |
| 5,195,188 | A | | 3/1993 | Bourdeau et al. |
| 5,214,799 | A | | 6/1993 | Fabry |
| 5,218,718 | A | | 6/1993 | Chih |
| 5,218,719 | A | | 6/1993 | Johnson |
| D338,280 | S | | 8/1993 | Krent et al. |
| 5,237,703 | A | | 8/1993 | Brine et al. |
| 5,253,365 | A | | 10/1993 | Clevenhagen |
| 5,257,418 | A | | 11/1993 | Jaskiewicz |
| 5,309,573 | A | | 5/1994 | Solar et al. |
| 5,323,490 | A | | 6/1994 | Yarbrough |
| 5,328,652 | A | | 7/1994 | Thomson |
| 5,329,639 | A | | 7/1994 | Aoki |
| 5,330,391 | A | | 7/1994 | Mitchell |
| 5,345,609 | A | | 9/1994 | Fabry et al. |
| 5,379,460 | A | | 1/1995 | Aoki |
| D356,203 | S | | 3/1995 | Mitch |
| D360,284 | S | | 7/1995 | Paffett et al. |
| 5,435,008 | A | | 7/1995 | Shane |
| 5,442,815 | A | | 8/1995 | Cordova et al. |
| 5,442,816 | A | | 8/1995 | Seketa |
| 5,459,878 | A | | 10/1995 | Gold |
| 5,462,280 | A | | 10/1995 | Dickerson |
| 5,471,682 | A | | 12/1995 | Robins et al. |
| 5,477,558 | A | | 12/1995 | Vülker et al. |
| 5,488,739 | A | | 2/1996 | Cardinal |
| 5,490,290 | A | | 2/1996 | Gold |
| 5,500,955 | A | | 3/1996 | Gongea |
| 5,511,242 | A | | 4/1996 | Bianchi |
| 5,511,243 | A | | 4/1996 | Hall et al. |
| 5,511,244 | A | | 4/1996 | Shikatani |
| 5,530,967 | A | | 7/1996 | Cielo |
| 5,551,083 | A | | 9/1996 | Goldsmith |
| 5,557,803 | A | | 9/1996 | Granich et al. |
| 5,564,122 | A | | 10/1996 | Wagner |
| 5,575,005 | A | | 11/1996 | Walker et al. |
| 5,581,809 | A | | 12/1996 | Mah |
| 5,592,688 | A | | 1/1997 | LaRonge et al. |
| 5,598,582 | A | | 2/1997 | Andrews et al. |
| 5,600,853 | A | | 2/1997 | Yewer, Jr. |
| 5,608,912 | A | | 3/1997 | Cumberland |
| 5,608,915 | A | | 3/1997 | Libit |
| 5,634,214 | A | | 6/1997 | St. Ville |
| 5,638,548 | A | | 6/1997 | Kawakami |
| 5,640,712 | A | | 6/1997 | Hansen et al. |
| 5,644,795 | A | | 7/1997 | Landis et al. |
| 5,655,221 | A | | 8/1997 | Worischeck |
| 5,655,226 | A | | 8/1997 | Williams |
| 5,659,897 | A | | 8/1997 | Satoh |
| D385,667 | S | | 10/1997 | Goldsmith et al. |
| 5,675,839 | A | | 10/1997 | Gordon et al. |
| 5,678,245 | A | | 10/1997 | Rector et al. |
| 5,682,613 | A | | 11/1997 | Dinatale |
| 5,685,014 | A | | 11/1997 | Dapsalmon |
| 5,692,242 | A | | 12/1997 | Tekerman et al. |
| 5,694,642 | A | | 12/1997 | Rector et al. |
| 5,697,103 | A | * | 12/1997 | Wiggins ..... 2/159 |

5,697,104 A 12/1997 Welton
D389,283 S 1/1998 Goldsmith et al.
5,708,979 A * 1/1998 Redwood et al. ..... 2/161.1
5,715,539 A 2/1998 Benecki et al.
5,717,994 A 2/1998 Goldsmith
5,717,995 A 2/1998 Murai
5,720,047 A 2/1998 Spitzer
5,745,916 A 5/1998 Linner
5,761,745 A 6/1998 Sato
5,781,929 A 7/1998 Shikatani
5,781,931 A 7/1998 Lee
5,785,617 A 7/1998 MacKay, Jr.
5,787,506 A 8/1998 Wilder et al.
5,790,980 A 8/1998 Yewer, Jr.
5,799,327 A 9/1998 Clevenhagen
5,802,614 A 9/1998 Melone, Jr.
5,806,092 A 9/1998 Shikatani
5,809,571 A 9/1998 Spitzer
5,815,839 A 10/1998 Safford
5,815,840 A 10/1998 Hamlin
5,819,312 A 10/1998 Snyder et al.
5,855,022 A 1/1999 Storto
5,878,436 A 3/1999 Jones
5,884,329 A 3/1999 Goldsmith et al.
5,887,282 A 3/1999 Lenhart
5,893,172 A 4/1999 Haynes et al.
5,898,938 A 5/1999 Baylor et al.
5,898,942 A 5/1999 Anderson
5,926,847 A 7/1999 Eibert
5,946,720 A 9/1999 Sauriol
5,963,985 A 10/1999 Behr et al.
5,983,396 A 11/1999 Morrow et al.
5,987,642 A 11/1999 Webster
5,987,646 A 11/1999 Bolmer
D417,757 S 12/1999 Aoki
5,996,117 A 12/1999 Goldsmith et al.
6,000,059 A 12/1999 Abts
6,016,571 A 1/2000 Guzman et al.
D420,173 S 2/2000 Aoki
D420,174 S 2/2000 Aoki
D420,202 S 2/2000 Redwood et al.
6,035,443 A 3/2000 Green
6,041,438 A 3/2000 Kikwood
6,049,910 A 4/2000 McCarter
6,052,827 A 4/2000 Widdemer
6,065,150 A 5/2000 Huang
D426,922 S 6/2000 Redwood et al.
6,085,352 A 7/2000 Martin
6,088,835 A 7/2000 Perkins et al.
6,098,200 A 8/2000 Minkow et al.
6,105,162 A 8/2000 Douglas et al.
6,122,769 A 9/2000 Wilder et al.
D431,691 S * 10/2000 Redwood et al. ..... D29/117.1
6,182,289 B1 2/2001 Brown
6,185,747 B1 2/2001 Hughes
6,216,276 B1 4/2001 Eibert
6,223,350 B1 5/2001 McFarlane
6,223,744 B1 5/2001 Garon
6,226,795 B1 5/2001 Winningham
6,233,744 B1 5/2001 McDuff
6,249,915 B1 6/2001 Hang
6,253,382 B1 7/2001 Kleinert
6,256,792 B1 7/2001 MacDonald
D445,996 S 8/2001 Kiernan
6,275,996 B1 8/2001 Redwood et al.
6,279,160 B1 8/2001 Chen
6,279,163 B1 8/2001 Hale et al.
6,289,515 B1 9/2001 Fous
6,289,516 B1 9/2001 Motooka et al.
6,321,387 B1 11/2001 Fukae
6,353,931 B1 3/2002 Gilligan et al.
6,378,925 B1 4/2002 Greenlee
6,389,601 B2 5/2002 Kleinert
6,405,380 B1 * 6/2002 Kuroda et al. ..... 2/161.1
6,415,444 B1 7/2002 Kleinert
6,415,445 B1 * 7/2002 Nishijima et al. ..... 2/161.4
D461,621 S 8/2002 Bevier
6,427,247 B1 * 8/2002 Suk ..... 2/161.2
6,430,745 B2 8/2002 Murai
D462,922 S 9/2002 Yuan et al.
6,453,474 B2 9/2002 Kleinert
D464,178 S 10/2002 Redwood et al.
6,460,184 B1 10/2002 Nishimura et al.
6,487,724 B1 12/2002 Aoki
D468,075 S 1/2003 Votel
6,502,244 B1 1/2003 Kleinert
6,516,470 B1 2/2003 Aoki
6,516,471 B1 2/2003 Baumann
6,519,781 B1 2/2003 Berns
D471,343 S 3/2003 Sun
D471,674 S 3/2003 Redwood et al.
6,526,592 B1 3/2003 Best
6,536,046 B1 3/2003 Gilligan
D474,863 S 5/2003 Sun
6,571,394 B1 6/2003 Hackett et al.
6,584,616 B2 7/2003 Godshaw et al.
6,651,255 B1 * 11/2003 Schild ..... 2/163
6,662,942 B1 12/2003 Bonzagni
6,668,379 B2 12/2003 Kleinert
6,681,402 B1 1/2004 Bevier et al.
6,701,530 B2 3/2004 Kleinert
6,708,346 B2 3/2004 Terris et al.
6,715,152 B2 4/2004 Mazzarolo
6,721,960 B1 4/2004 Levesque et al.
6,732,377 B1 5/2004 Wilkinson
6,745,402 B2 6/2004 Caswell
6,760,923 B1 7/2004 Tate
6,760,924 B2 7/2004 Hatch et al.
D495,097 S 8/2004 Redwood et al.
6,775,847 B2 8/2004 Terris et al.
D499,529 S 12/2004 Kleinert
D499,856 S 12/2004 Kleinert
6,862,744 B2 * 3/2005 Kuroda et al. ..... 2/161.1
6,961,960 B2 11/2005 Gold et al.
D513,828 S 1/2006 Bevier
7,000,256 B2 2/2006 Kleinert
D516,277 S 3/2006 Mattesky
D529,236 S 9/2006 Litke et al.
7,100,212 B2 * 9/2006 Jaeger ..... 2/161.1
D532,162 S 11/2006 Bonzagni et al.
D545,002 S 6/2007 Voravan
D549,398 S 8/2007 Swartz et al.
D554,808 S 11/2007 Litke et al.
D570,056 S 5/2008 Metcalf
7,406,719 B2 8/2008 Aoki
D583,527 S 12/2008 Kleinert
D583,528 S 12/2008 Kleinert
7,464,446 B2 12/2008 Johansson
D584,026 S 1/2009 Kleinert
7,707,653 B2 5/2010 Kleinert
2001/0025382 A1 10/2001 Murai
2001/0054190 A1 12/2001 Kleinert
2002/0013961 A1 2/2002 Kleinert
2002/0040494 A1 4/2002 Kleinert
2002/0042940 A1 * 4/2002 Kuroda et al. ..... 2/161.1
2002/0152536 A1 * 10/2002 Kuroda et al. ..... 2/161.1
2003/0005506 A1 1/2003 Like
2003/0050586 A1 3/2003 Domanski et al.
2003/0056273 A1 3/2003 Kleinert
2004/0016038 A1 1/2004 Motooka et al.
2004/0025226 A1 2/2004 Jaeger
2004/0025227 A1 2/2004 Jaeger
2004/0103465 A1 6/2004 Kleinert
2004/0107476 A1 * 6/2004 Goldwitz ..... 2/159
2004/0123371 A1 7/2004 Bryant, Sr.
2004/0216207 A1 11/2004 Anderson

| | | | |
|---|---|---|---|
| 2005/0034213 | A1 | 2/2005 | Bamber |
| 2005/0114982 | A1 | 6/2005 | Gremmert |
| 2007/0061943 | A1 | 3/2007 | Kleinert |
| 2007/0150998 | A1 | 7/2007 | Atherton |
| 2007/0209097 | A1 | 9/2007 | Iacullo |
| 2008/0052799 | A1 | 3/2008 | Yoo |
| 2008/0060115 | A1 | 3/2008 | Morris |
| 2008/0141435 | A1 | 6/2008 | Friedman |
| 2009/0139010 | A1 | 5/2009 | Bevier |

FOREIGN PATENT DOCUMENTS

| | | |
|---|---|---|
| JP | 401171849 | 7/1989 |
| JP | 09182825 | 7/1997 |
| JP | 02003020504 | 1/2003 |
| WO | 9716085 | 5/1997 |
| WO | WO- 0308206 | 10/2003 |

* cited by examiner

GLOVE

BACKGROUND OF THE INVENTION

1. Field of the Invention

This invention relates to gloves for the human hand which are particularly useful in participating in activities which include the clinching of the hand for substantially long periods of time. More particularly, this invention relates to a glove specifically designed to provide expandable zones over the metacarpalphalangeal joints which allows for expansion of the glove at selected locations in both the horizontal and vertical plane.

2. Description of the Related Art

Glove construction for protection of the human hand is well known. Moreover, gloves have been designed for specific uses and particularly for specific and various athletic activities. For example, U.S. Pat. No. 6,389,601, teaches a glove particularly for use as a batting glove in baseball and softball which includes padding over selected pulleys and tendons of the fingers to prevent injury when striking a ball with a bat, particularly an aluminum bat. U.S. Pat. No. 3,175,226, for example, teaches a dress glove construction which completely covers the fingers and includes resiliently expandable materials in selected areas to accommodate hands of different sizes. U.S. Pat. No. 5,345,609 teaches a glove which includes shock absorbing cells disposed at selected portions along the top of the glove and U.S. Pat. No. 5,790,980 teaches a glove with a foam pad in the palm portion of the glove. Other prior art references attempt to provide sport gloves for supporting and stabilizing the wrist and the hand.

In activities which require the clinching of the hand, such as the gripping of handle bars of a bicycle or a motorcycle or ski sticks in cross-country skiing, the hands and particularly the fingers may be clenched for long periods of time. Thus, it is important that the blood circulation in the hands and the fingers function comfortably. For example, U.S. Pat. No. 3,997,922, teaches a glove particularly for use in cross-country skiing which is provided with cuts along the knuckles with pieces inserted therein having a larger diameter in the longitudinal direction of the glove than the respective dimension of the cuts.

SUMMARY OF THE INVENTION

An object of the present invention is to provide a glove which takes stress off selective parts of the human hand when the hand is in a clinching condition.

Another object of the present invention is to provide a glove that does not restrict the blood circulation in the hand and fingers when the hand, including the fingers, are in a clinched condition for extended periods of time.

It is even another object of the present invention to provide a glove for use in clinching handlebars of bicycles or motorcycles or ski sticks as well as clinching garden tools, golf clubs, steering wheels, and the like.

Even a further object of the present invention is to provide a glove that expands in both longitudinal and horizontal or lateral directions when the hand is a clinched condition.

More particular, the present invention provides a glove which has a first expandable zone disposed on the top portion of the glove for positioning over the metacarpalphalangeal joint center axis of rotation of an index finger and a second expandable zone disposed on the top portion of the glove for positioning over a metacarpalphalangeal joint center axis of rotation of a small finger. Even further, a third expandable zone may be disposed on the top portion of the glove for positioning over the metacarpalphalangeal joints center axis of rotation of the ring finger and the long finger.

Further objects and advantages of the invention will appear from the following description and appended claims.

BRIEF DESCRIPTION OF THE DRAWINGS

A better understanding of the invention will be had upon reference to the following description in conjunction with the accompanying drawings in which like numerals refer to like parts throughout the several views and wherein.

DESCRIPTION OF THE PREFERRED EMBODIMENT

Figure 1:
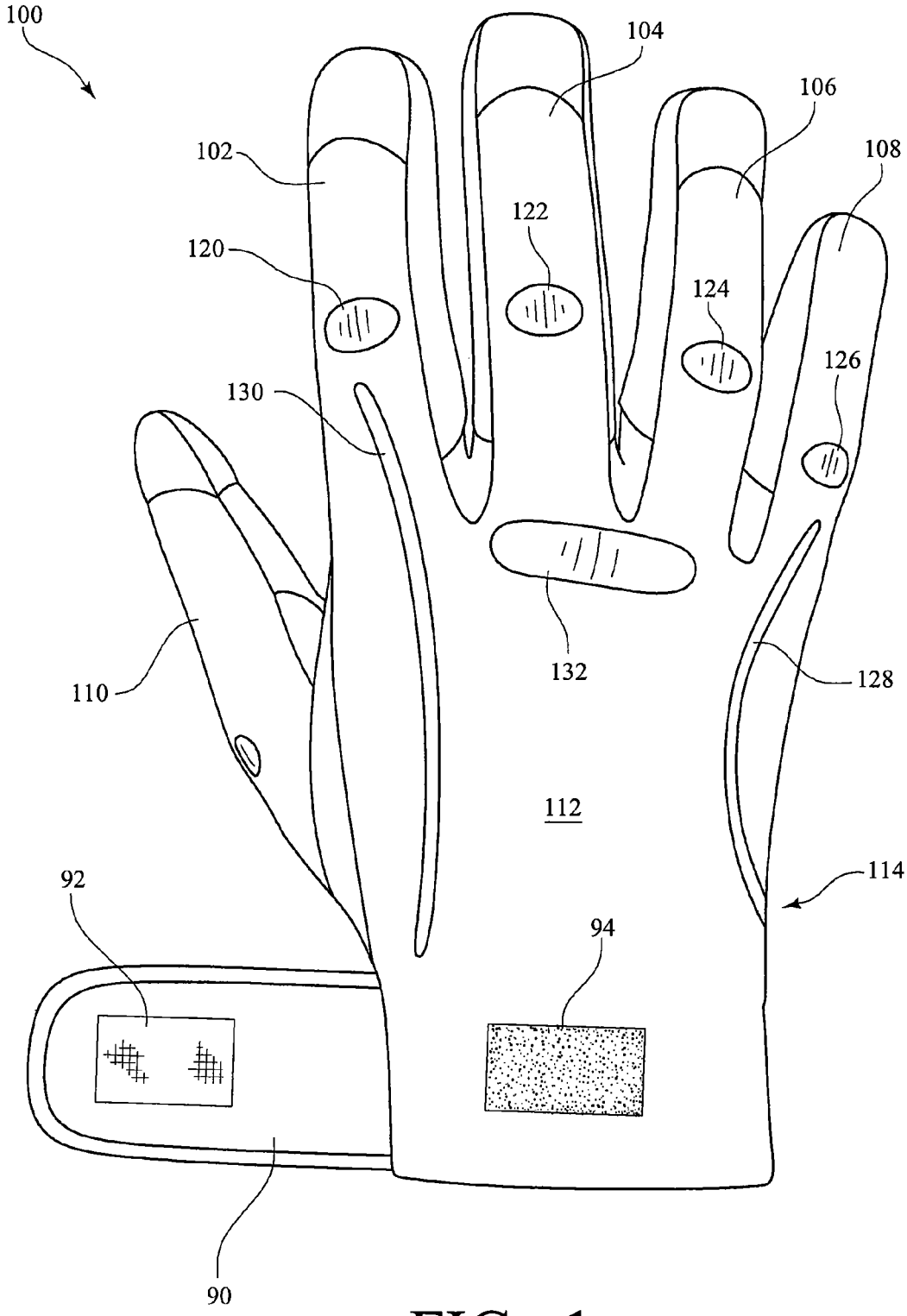
FIG. 1 is a top view of a glove of a preferred embodiment of the present invention.
Figure 1A:
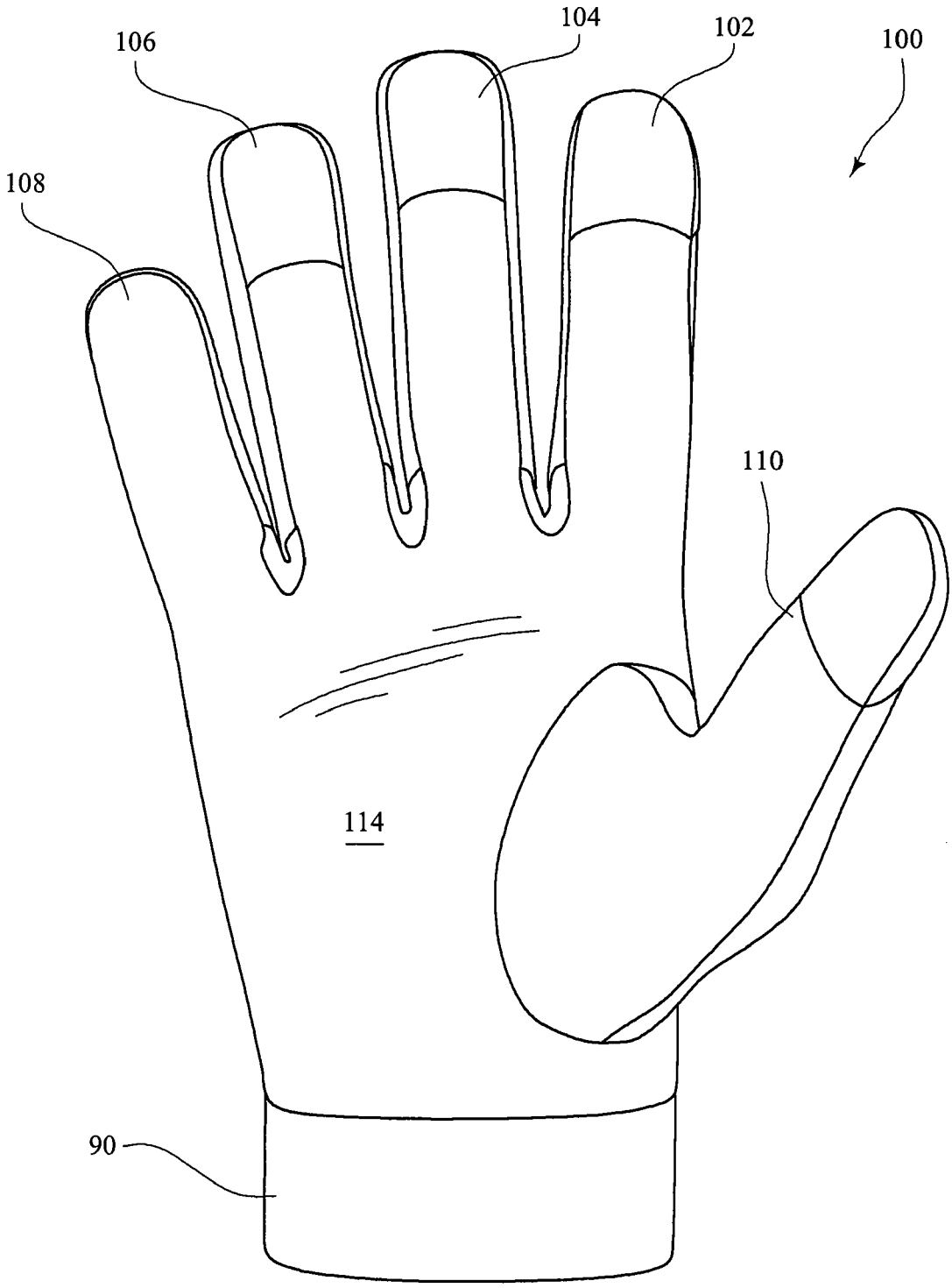
FIG. 1A is a bottom view of the glove of FIG. 1.

In FIGS. 1 and 1A, a preferred glove 100 is provided for either a right, left or both human hand(s) 10, as desired. A glove 100 for a left hand 10 utilizes symmetrical placement of the elements, materials and thicknesses herein described.

As shown in FIGS. 1 and 1A, the preferred glove 100 is exemplified for the right hand. The glove 100 is provided with a top portion 112 for covering a back side of the hand 10 including a top side of elongated sections to receive a plurality of fingers therein and a lower portion 114 to over a palm side of a hand 10 including a bottom side of elongated sections to receive the plurality of fingers therein. The elongated sections are identified by numeral 102 for an index finger, elongated section 104 for a long finger, elongated section 106 for a ring finger, and elongated section 108 for a small finger. A thumb section identified by numeral 110 is also provided.

As best shown in FIG. 1, a first expandable zone 128 is positioned vertically or longitudinally along a selected portion of small finger section 108 and a second expandable zone 130 is positioned vertically or longitudinally along a selected portion of the index finger section 102. A third expandable zone identified by the numeral 132 is horizontally or laterally positioned over selected portions of the knuckle area of the long finger and the ring finger. Expandable zones may also be provided, such as those identified by the numerals 120, 122, 124, and 126, over selected joints of fingers 102, 104, 106, and 108, respectively. The expandable zones are generally prepared by cutting appropriate slits or openings at selected locations of the glove for the expandable zones and sewing in pieces of appropriate materials including elastic materials which yield upon bending of the glove. A preferred material for the expansion zones 128, 130 and 132 include elastic materials such as, for example, 2-way SPANDEX® or LYCRA®. Moreover, the top portion 112 and the bottom portion 114 is usually made from a material which provides protection from abrasion and may be made of a cloth, a leather, or a synthetic material or the like.

Figure 2:
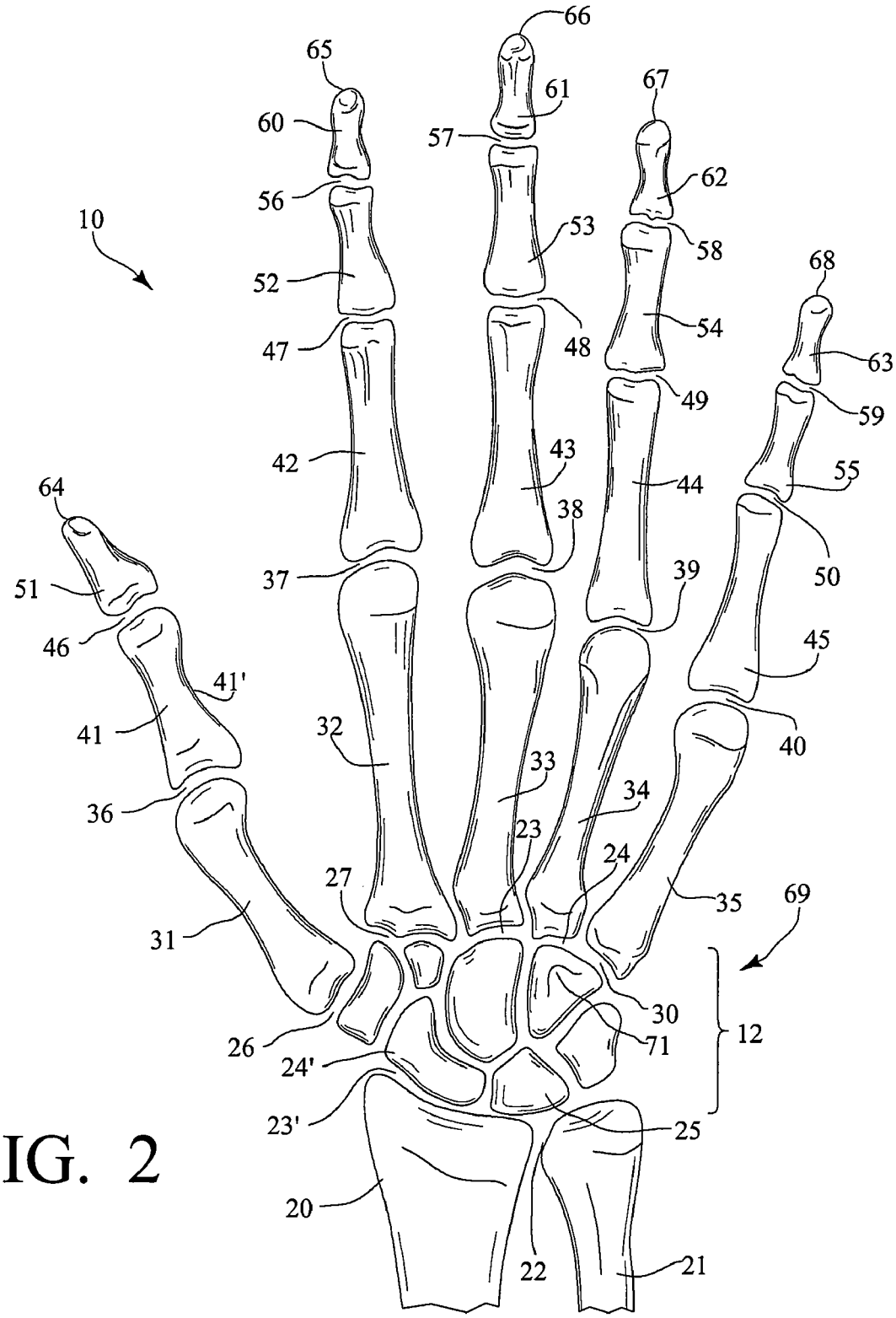
FIG. 2 is a schematic anatomical view of the bones of the right-side human hand showing the dorsal-side details.

FIG. 2 is a schematic anatomical view of the bones of a right human hand 10 looking at a palm 18 side. Shown are the radius 20, ulna 21, radiocarpal joint (RC) 23, distal radio ulna joint (DRUJ) 22, wrist 12, thumb 64, index finger 65, long finger 66, ring finger 67, and small finger 68. The carpus 69 comprises eight carpal bones, seven of which are shown in FIG. 2 and includes the hamate bone 71 with its hook-like protrusion, the scaphoid 24' and the lunate 25. The thumb 64 is comprised of the distal phalanx 51, the interphalangeal joint (I) 46, proximal phalanx 41, diaphysis of proximal phalanx 41, metacarpalphalangeal joint (MCP) 36, metacarpal 31, and carpometacarpal joint (CMC) 26. The index finger 65 is comprised of the distal phalanx 60, distal interphalangeal joint (DIP) 56, middle phalanx 52, proximal interphalangeal joint (PIP) 47, proximal phalanx 42, metacarpal 32, metacarpalphalangeal joint (MCP) 37, and carpometacarpal joint (CMC) 27. The long finger 66 is comprised of the distal phalanx 61, distal interphalangeal joint (DIP) 57, middle phalanx 53, proximal interphalangeal joint (PIP) 48, proximal phalanx 43, metacarpalphalangeal joint (MCP) 38, metacarpal 33, and carpometacarpal joint (CMC) 23. The ring finger 67 is comprised of the distal phalanx 62, distal interphalangeal joint (DIP) 58, middle phalanx 54, proximal interphalangeal joint (PIP) 49, proximal phalanx 44, metacarpalphalangeal joint (MCP) 39, metacarpal 34, and carpometacarpal joint (CMC) 24. The small finger 68 is comprised of the distal phalanx 63, distal inter phalangeal joint (DIP) 59, middle phalanx 55, proximal interphalangeal joint (PIP) 50, proximal phalanx 45, metacarpalphalangeal joint (MCP) 40, metacarpal 35, and carpometacarpal joint (CMC) 30.

Figure 3:
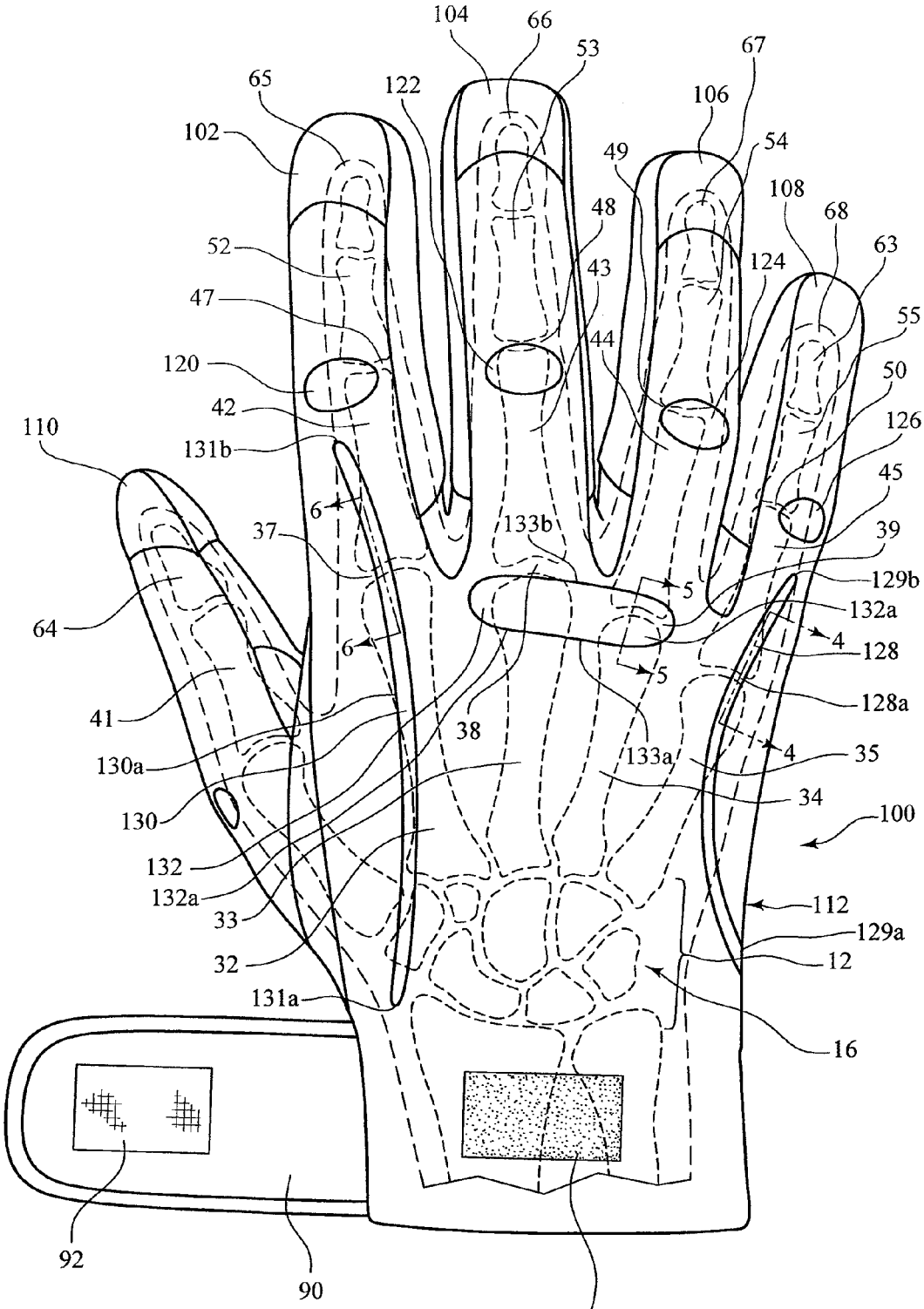
FIG. 3 is a top view of a glove of FIG. 1 showing the dorsal-side details and overlaying the skeletal structure of a right-dorsal side human hand.

FIG. 3 shows details of a dorsal side of a glove 100 to cover a human hand 10 and is seen overlaying the skeletal structure and skin outline of a right-dorsal-side human hand 10. The glove 100 has a plurality of finger elements, 102, 104, 106 and 108, a thumb element 110, a top portion 112, and a lower portion 114 (See FIG. 1A), wherein the finger elements 102, 104, 106, and 108 cover fingers 65-68 respectively. The thumb element 110 covers a thumb 64, and the top portion 112 covers a back side 16 of the hand 10. The lower portion 114 (See FIG. 1A) covers the palm side (not shown) of the hand 10. An elastic band 90 is attached to the top portion 112 and to the lower portion 114. The elastic band 90 includes a securing means in the form of a hook 92 and a loop 94 fastener for retention above a human wrist 12.

Figure 4:
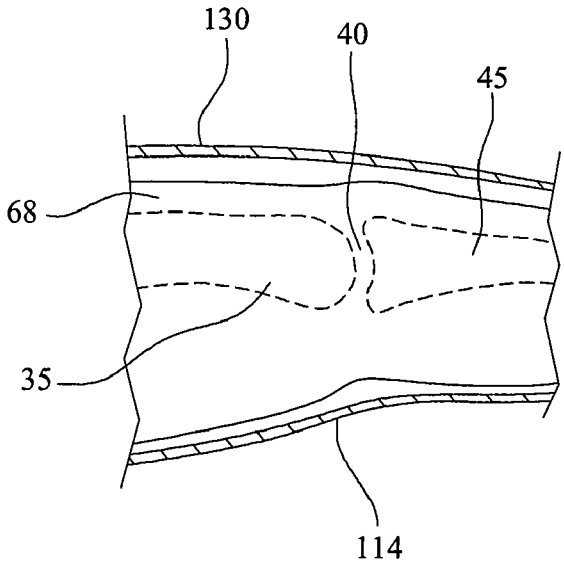
FIG. 4 is an enlarged sectional view taken along line 4-4 of FIG. 3 showing a selected location for one expandable zone in a preferred embodiment of the present invention.

Referring now to FIGS. 3 and 4, the first expandable zone 128 is disposed on the top portion 112 of the glove 100 for positioning vertically or longitudinally over the metacarpalphalangeal joint 40 of the small finger 68. The first expandable zone 128 is preferably of an elastic material, as noted previously, and is sewn into a slit 128*a* in the small finger element 108 and has one terminating end 129*a* below the midpoint of the metacarpal 35 of small finger 68 and a second terminating end 129*b* above the midpoint of a proximal phalanx 45 of the small finger 68. The first expandable zone 128 is substantially coextensive with said slit 128*a*. Preferably, the length of expansion zone 128 is from 1 to 3 inches below and above the center axis of rotation of the metacarpalphalangeal joint 40. Moreover, the width of the expandable zone 128 is from 1/16 to 1/2 inches and preferably about 1/8 to 3/8 inches so that the expandable zone extends substantially greater longitudinally than laterally.

Figure 5:
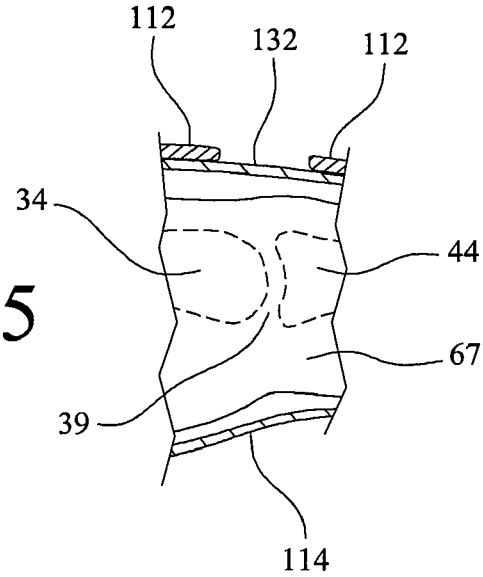
FIG. 5 is a sectional view taken along line 5-5 of FIG. 3 showing a selected location for a second expandable zone of the glove of the preferred embodiment of the present invention; and, FIG. 6 is a sectional view taken along line 6-6 of FIG. 3 showing a selected location for a third expandable zone of the glove of the present invention.

Referring now to FIGS. 3 and 5, a second expandable zone 130 is disposed on the top portion 112 of the glove 100 for positioning vertically or longitudinally over the metacarpahalphalangeal joint 37 of the index finger 65. The second expandable zone is also preferably an elastic material and is sewn into a slit 130*a* in the index finger element 102 and has one terminating end 131*a* below the midpoint of the metacarpal 32 and a second terminating end 131*b* above the midpoint of the a proximal phalanx 42 of the index finger 65. The second expandable zone 130 is substantially coextensive with said slit 130*a*. Preferably, the length of expansion zone 130 is from 1 to 3 inches below and above the center axis of rotation of the metacarpalphalangeal joint 37. Moreover, the width of the expansion zone 130 is from 1/16 to 1/2 inches, preferably about 1/8 to 3/8 inches so that the expandable zone extends substantially greater longitudinally than laterally.

Figure 6:
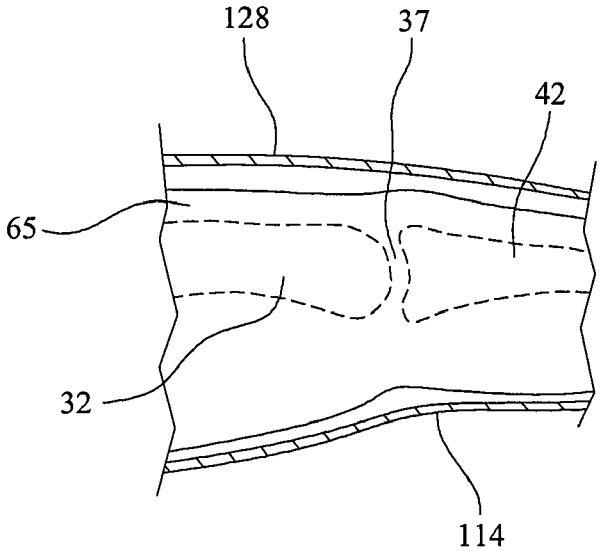

Referring now to FIGS. 3 and 6, a third expandable zone 132 is disposed on the top portion 112 of the glove 100 for positioning horizontally or laterally over the metacarpalphanalgeal joints 38 and 39 of the long finger 66 and the ring finger 67, respectively. The third expandable zone 132 is also preferably an elastic material and is sewn into a slit 132*a* in the finger elements 104 and 106. Third expandable zone 132 has one terminating side 133*a* adjacent the distal ends of the metacarpals 33 and 34 of the long finger 66 and the ring finger 67 and a second terminating side 133*b* adjacent to the proximal ends of the proximal phalanx 43 of the long finger 66 and the proximal phalanx 44 of the ring finger 67. The third expandable zone 132 also has one terminating end adjacent to the metacarpalphalangeal joint 40 of the small finger 33 and a second terminating end adjacent to the metacarpalphalangeal joint 37 of the index finger 65. The third expandable zone 132 is substantially coextensive with said slit 132*a*.

Referring back to FIG. 3, expandable zones may also be provided at selected portions over other joints of the fingers. As shown in FIG. 3, an expandable zone 120 is positioned over the center axis of rotation of the proximal interphalangeal joint 47 of the index finger 65; an expandable zone 122 is disposed over the center axis of rotation of the proximal interphalangeal joint 48 of the long finger 66; expandable zone 124 is disposed over the proximal interphalangeal joint 49 of the ringer finger 67; and, expansion zone 126 is disposed over the proximal interphalangeal joint 50 of the small finger 68.

As noted hereinbefore, the materials of construction of the expandable zones is preferably an elastic material, such as, 2-way SPANDEX® or LYCRA®. Thus, when a hand is inserted into the glove and the hand is clinched around handle bars, ski sticks, or the like, the length of the upper side of the glove is increased due to the expansion of the elastic material covering the metacarpalphalangeal joints 38 and 39 and the width of the glove is also increased due to the expansion of the elastic materials in the expansion zones 128 and 130.

The detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A glove constructed to fit a hand of predetermined size for protecting selected anatomical portions thereof comprising:

a covering for said hand with separate elongated sections to receive a plurality of fingers therein, said covering having a top portion for covering a back side of the hand including a top side of the elongated sections to receive a plurality of fingers and a lower portion to cover a palm side of the hand including a bottom side of the elongated sections to receive said plurality of fingers;

a first longitudinally extending expandable zone disposed in a slit in a small finger section in the top portion of said glove for positioning over the center axis of rotation of the metacarpalphalangeal joint of a small finger and a second expandable zone disposed in a slit in an index finger section in the top portion of said glove for positioning over the center axis of rotation of the metacarpalphalangeal joint of an index finger, said first expansion zone having one terminating end below the midpoint of a small finger metacarpal and a second terminating end between the midpoint and the distal end of a proximal phalanx of said small finger and said second expansion zone having one terminating end below the midpoint of an index finger metacarpal and a second terminating end between the midpoint and the distal end of a proximal phalanx of said index finger said expansion zones being substantially coextensive with said slits, whereby said first and said second expandable zones extend substantially greater in a longitudinal direction than a lateral direction.

2. The glove of claim 1, including a third laterally extending expansion zone disposed in a slit in the top portion of said glove positioned over the center axis of rotation of the metacarpalphalangeal joints of a ring finger and a long finger said expansion zones being substantially coextensive with said slits.

3. The glove of claim 2, said third expansion zone having one terminating side adjacent the distal ends of the metacarpals of said long finger and said ring finger and a second terminating side adjacent to the proximal ends of the proximal phalanx of said long finger and said ring finger.

4. The glove of claim 2, said third expansion zone having one terminating end adjacent to said metacarpalphalangeal joint of said small finger and a second terminating end adjacent to said metacarpalphalangeal joint of said index finger.

5. The glove of claim 1, said expandable zone having one terminating end from 1 to 3 inches below the center axis of rotation of said metacarpalphalangeal joint of said at least one finger and an opposed second terminating end from 1 to 3 inches above the center axis of rotation of said metacarpalphalangeal joint of said at least one finger.

6. A glove constructed to fit a hand of predetermined size for protecting selected anatomical portions thereof comprising:

a covering for said hand with separate elongated sections to receive a plurality of fingers therein, said covering having a top portion for covering a back side of the hand including a top side of the elongated sections to receive a plurality of fingers and a lower portion to cover a palm side of the hand including a bottom side of the elongated sections to receive said plurality of fingers;

a first longitudinally extending expandable zone disposed in a slit in a small finger section in the top portion of said glove for positioning over the center axis of rotation of the metacarpalphalangeal joint of a small finger and a second expandable zone disposed in a slit in an index finger section in the top portion of said glove for positioning over the center axis of rotation of the metacarpalphalangeal joint of an index finger, said first expansion zone having one terminating end below the midpoint of a small finger metacarpal and a second terminating end between the midpoint and the distal end of a proximal phalanx of said small finger and said second expansion zone having one terminating end below the midpoint of an index finger metacarpal and a second terminating end between the midpoint and the distal end of a proximal phalanx of said index finger said expansion zones being substantially coextensive with said slits, whereby said first and said second expandable zones extend substantially greater in a longitudinal direction than a lateral direction; and, a third laterally extending expansion zone disposed in a slit in the top portion of said glove positioned over the center axis of rotation of the metacarpalphalangeal joints of a ring finger and a long finger whereby upon bending of the glove, the glove expands both longitudinally and laterally over the metacarpalphalangeal joints.

7. The glove of claim 6, said third expansion zone having one terminating side adjacent the distal ends of the metacarpals of said long finger and said ring finger and a second terminating side adjacent to the proximal ends of the proximal phalanx of said long finger and said ring finger.

8. The glove of claim 6, said third expansion zone having one terminating end adjacent to said metacarpalphalangeal joint of said small finger and a second terminating end adjacent to said metacarpalphalangeal joint of said index finger.

9. The glove of claim 6, said first and said second expandable zones having one terminating end from 1 to 3 inches below and an opposed second terminating end from 1 to 3 inches above said metacarpalphalangeal joints of said small finger and said index finger.

10. The glove of claim 1, said first and said second expandable zones having a width of from ⅛ to ⅜ inches.

11. The glove of claim 6, said first and said second expandable zones having a width of from ⅛ to ⅜ inches.

12. The glove of claim 1, said first and said second longitudinally extending expandable zones including an elastic material therein.

13. The glove of claim 6, said first and said second longitudinally extending expandable zones including an elastic material therein.

* * * * *

UNITED STATES PATENT AND TRADEMARK OFFICE

CERTIFICATE OF CORRECTION

PATENT NO. : 7,895,670 B2
APPLICATION NO. : 11/462075
DATED : March 1, 2011
INVENTOR(S) : James M. Kleinert It is certified that error appears in the above-identified patent and that said Letters Patent is hereby corrected as shown below:

On Title Page 2, Item (56) of the U.S. PATENT DOCUMENTS, line 57 beginning with 4,700,404, delete, "Potvin" and insert ,-- Lespérance --;

On Title Page 2, Item (56) of the U.S. PATENT DOCUMENTS, line 41 beginning with 5,477,558, delete, "Vülker, et al." and insert, -- Völker, et al. --;

Column 1, line 59, insert, -- in -- between, "is" and "a".;

Column 2, line 19, delete the "-" between "right dorsal";

Column 3, line 4, delete, "18"; line 36, delete the "-" between "right dorsal"; line 67, delete, "metacarpahalphalangeal" and insert, -- metacarpalphalangeal --; and, Column 4, line 6, delete, "a"; line 27, delete, "33" and insert, -- 68 --.

Signed and Sealed this
Fifteenth Day of May, 2012

David J. Kappos

David J. Kappos
*Director of the United States Patent and Trademark Office*